US005520403A

United States Patent [19]

Bergstrom et al.

[11] Patent Number: 5,520,403

[45] Date of Patent: May 28, 1996

[54] WHEELCHAIR WITH TRANSLATING SEAT AND PATIENT LIFT

[76] Inventors: Michele R. Bergstrom, 17 Richmond Rd., Norwood, Mass. 02062; Charles Bickoff, 63 Eisenhower Dr., Sharon, Mass. 02067

[21] Appl. No.: 411,953

[22] Filed: Mar. 28, 1995

[51] Int. Cl.[6] ..... A61G 5/10

[52] U.S. Cl. ..... 280/250.1; 280/42; 414/528; 414/921; 5/81.1 C; 5/86.1; 297/DIG. 4

[58] Field of Search ..... 280/250.1, 304.1, 280/42; 414/528, 921; 5/81.1, 83.1, 86.1; 297/DIG. 4

[56] References Cited

FOREIGN PATENT DOCUMENTS

| | | | |
|---|---|---|---|
| 5-23370 | 2/1993 | Japan | 280/250.1 |
| 5-95977 | 4/1993 | Japan | 280/250.1 |
| 5-220196 | 8/1993 | Japan | 280/250.1 |
| 5-293140 | 11/1993 | Japan | 280/250.1 |
| WO94/16660 | 8/1994 | WIPO | 280/250.1 |

*Primary Examiner*—Eric D. Culbreth
*Assistant Examiner*—F. Zeender
*Attorney, Agent, or Firm*—Charles Bickoff

[57] ABSTRACT

A wheelchair having a set of features which facilitate transfering a patient to an alternative surface and raising the chair to an alternative seating height. The first of these features enables each of the handwheels to be independently pivoted rearward by raising its related arm rest. The motion of the wheel is over centering and its rearward position is determined by a brake pad which engages its respective handwheel. The rearward position of the handwheel is such as to clear the rear of the seat. The forward position is determined with the arm rest in the normal down position and latched to the frame. The second feature is a lifting mechanism for raising the patient to the level of an alternative surface such as a bed. The third feature has the seat surface fabricated from a moveable belt which laterally transports the patient to the alternative surface. The wheelchair also has an embodiment which allows folding for easy transport.

19 Claims, 6 Drawing Sheets

WHEELCHAIR WITH TRANSLATING SEAT AND PATIENT LIFT

BACKGROUND

1. Field of the Invention

The present invention pertains to the field of Wheelchairs. In general, such devices have been designed to transport individuals with physical problems which preclude their ability to move about easily through the use of their legs or who may temporarily need assistance. Such patients may be debilitated in many different ways and a variety of devices have been designed to overcome many of the limitations that such patients have. It is also recognized that many such patients are unable to move themselves between the wheelchair and their bed.

Standard hand-operated wheelchairs are limited in their ability to facilitate easy transfer of patients from the chair to another surface. This is due to the size of the wheel which is higher than the normal seat level. Additionally, many of these chairs have arm rests which are fixed in position.

Many such patients have elderly or otherwise infirm care-givers who have difficulty in accomplishing or aiding such transfers. The present invention aims to facilitate the transfer of patients from the chair to other surfaces through many innovative features.

2. Prior Art

U.S. Pat. No. 5,161,812 invented by John DeWeese discloses his invention for an elevating wheelchair operated by hydraulics with the addition of commode features. The lifting mechanism is a pair of collapsible links spread or collapsed by a hydraulic cylinder. The vertical motion is guided by a set of vertical restraining guide tubes. His implementation has raisable arms, a wheel brake, and a pin lock for upper position safety.

U.S. Pat. No. 5,046,571, invented by Bjorn Kullerud of Norway presents an electrically operated lifting mechanism. It is a very specific mechanism for raising and lowering a patient. It does not show nor claim a backrest or any other trunk support for a patient in the seated position.

U.S. Pat. No. 4,934,723, invented by Edward Dynars, shows another implementation of a raising wheelchair. It claims several motive sources including pneumatic, hydraulic, and springs. It offers methods of actuation in general and by lifting the arm. The chair is raised by lowering and pivoting outward a set of feet to engage the floor and raise the chair. This chair is intended to bring the patient to the eye level height of a standing person while remaining seated.

U.S. Pat. No. 4,862,997, invented by Kenneth Eberle, shows another implementation of a raisable wheelchair for essentially the same purposes as the Dynars patent. Its main difference is that the seat portion raises the patient while the wheels remain engaged with the floor. It uses electrical means to raise the seat and trunk support portions.

The present invention addresses the above limitations in several ways.

THE INVENTION OBJECTS

Several objects and advantages of the present invention include:

a. providing a wheelchair with an ability to raise the patient to the level of a bed or other suitable surface and lower the patient to a normal wheelchair operating height when transferring from a bed or other surface.

b. providing a wheelchair with an ability for the hand-operated wheels to individually articulate rearward to clear the obstruction of a hand-operated wheel.

c. providing a wheelchair with a seat having an ability to bi-directionally laterally transport the patient toward a bed or other surface.

d. providing a wheelchair with a wheel locking means.

e. providing a wheelchair with an arm articulating means with said articulating arm means coupled to the hand wheel rearward articulating means.

Another object is to provide a wheelchair with a manual means to raise the seat.

Another object is to provide a wheelchair with a manual means to translate the patient.

A further object is to provide a wheelchair wherein the seat raising means is power driven.

An additional object is to provide a wheelchair wherein the seat translation means is power driven.

Additional objects will be obvious to those skilled in the art from the drawings and detailed description which follows.

DRAWINGS

SUMMARY

The invention herein described is for a Wheelchair with Translating Seat and Patient Lift. The wheelchair has features which allow the arms to be articulated rearward in a fashion to move its coupled hand wheel rearward to unobstruct its side of the chair. The motion of the wheel is over centering and a combined stop and brake locks the wheel in place with wheel in its rearward position. The seat is a beltlike structure which allows the patient to be laterally translated toward either side using a manual crank or power driven means. The seat mechanism may also be vertically raised or lowered. In order to transfer a patient to a bed, the seat is raised in line or slightly above the surface of the bed. A transfer board is placed across the gap between the seat and the bed and the seat is laterally advanced to transfer the patient toward the bed. To move the patient from the bed to the wheelchair, the process is reversed.

DETAILED DESCRIPTION OF THE BEST MODE

The following description illustrates the invention by way of example, not by way of limitation of the principles of the invention. The description will clearly enable one skilled in the art to make and use the invention. It describes embodiments, variations, and adaptations including what I believe to be the best mode.

Figure 1:
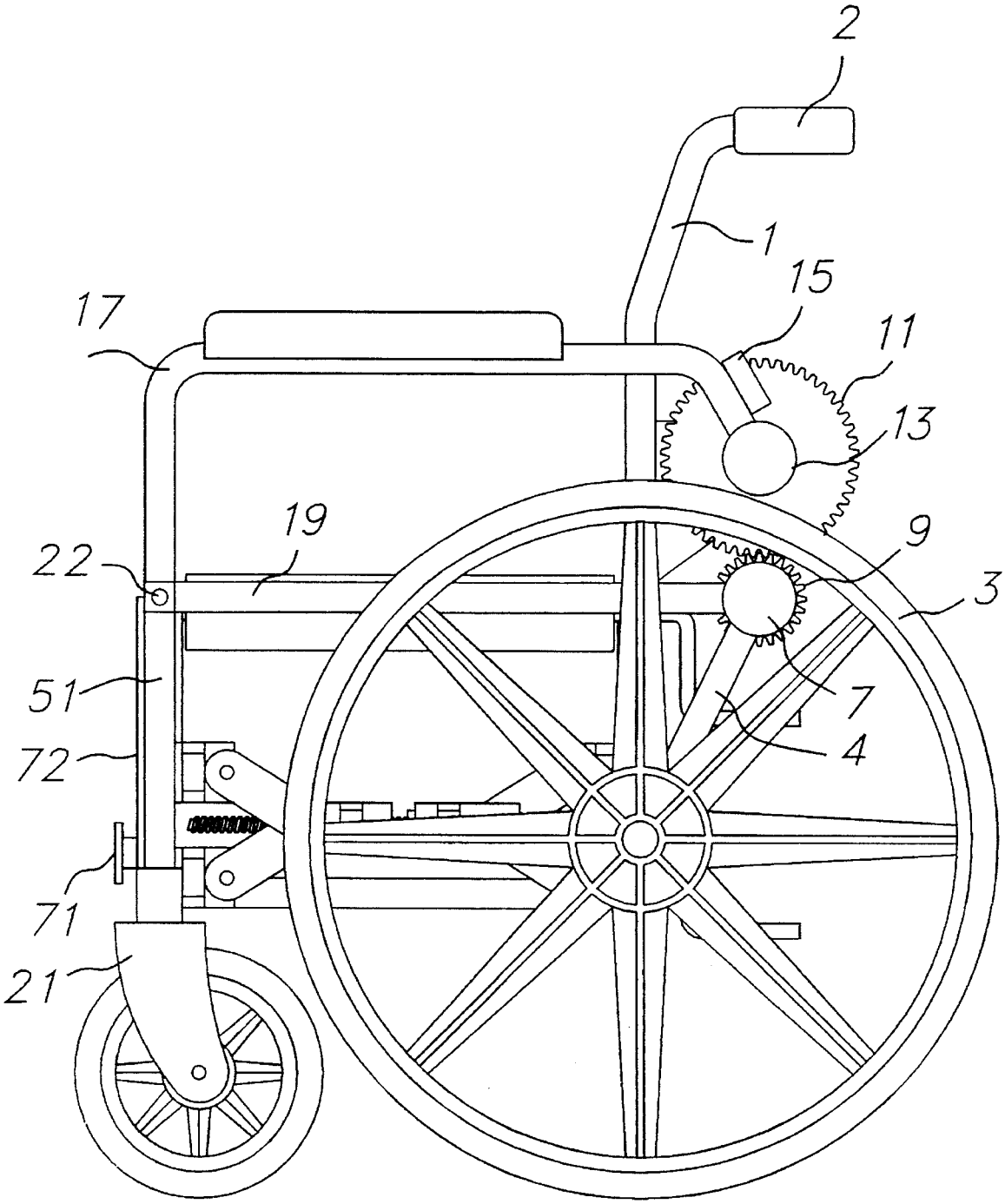
FIG. 1 is a Side View of the wheelchair.

The preferred embodiment of the Wheelchair is shown in FIGS. 1 through 6. FIG. 1 shows a side view of the wheelchair and is generally defined by the numeral 1. It is comprised of a seat side frame 19 to which is pivotally attached a pair of hand wheel links 4 approximately in line with the vertical support of the seat back. Said hand wheel link has a hand wheel link gear like device 9 affixed to a first end of said link and is pivotally attached to said seat side frame by pivot 7. A second end of said hand wheel link is pivotally attached to a floor engaging hand wheel 3. A front pair of castored wheels 21 are attached to vertical member 51 of said seat side frame 19. Said floor engaging handwheel is held in position by the pivoted arm assembly generally depicted as 17. Said pivoted arm assembly has a first end latchably attached by latch 22 to said seat side frame 19 and a second end pivotally attached by pivot assembly 13 to pivot bracket 66 which is fixedly attached to the rear vertical member of said seat side frame 19. Said second end of said pivoted arm assembly 17 has a pivot arm gear like device 11 fixedly attached. Said pivot arm gear like device 11 matingly engages said hand wheel link gear like device 9. Said second end of said pivoted arm assembly has affixed a hand wheel engaging brake pad 15.

Figure 2:
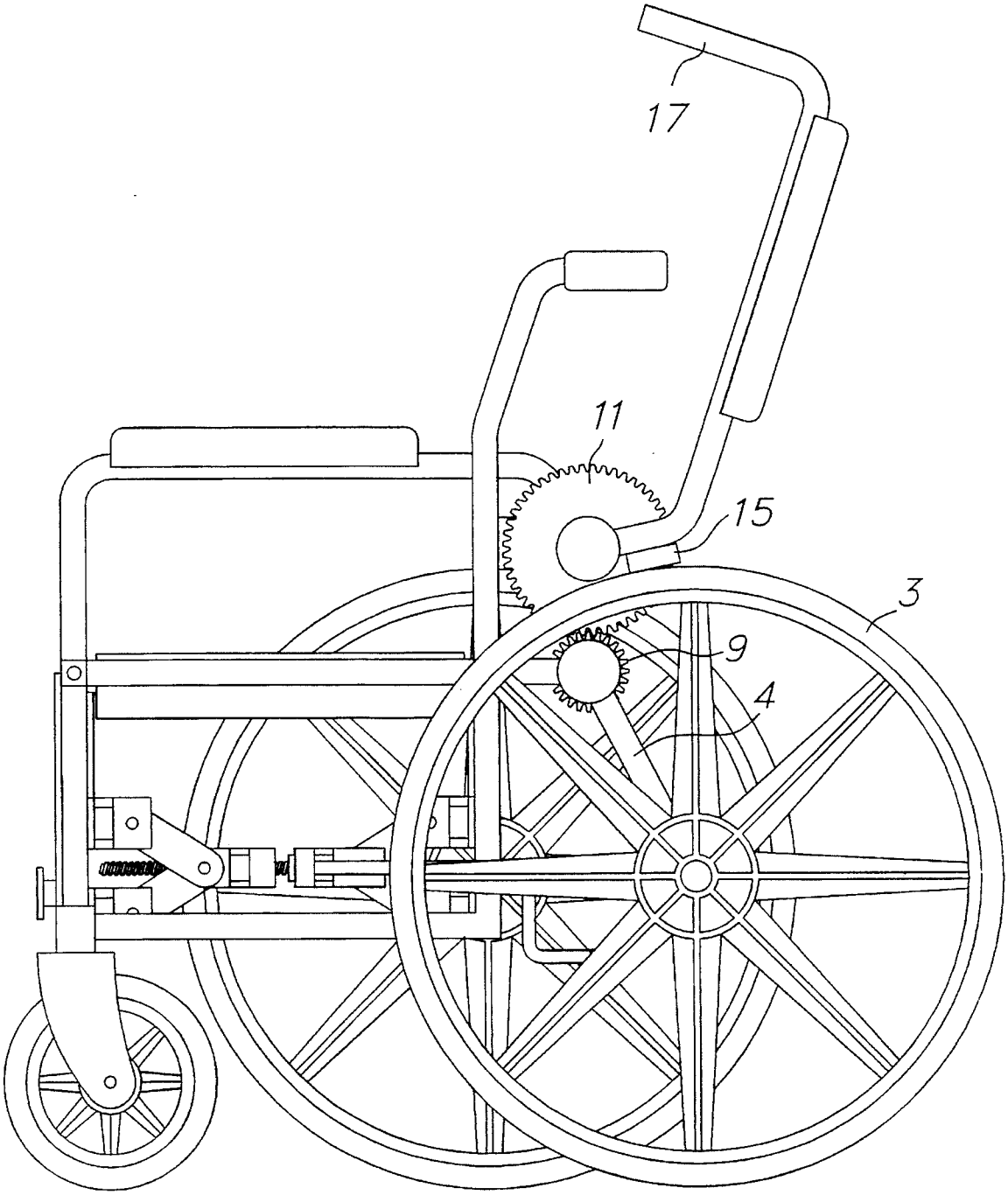
FIG. 2 is a Side View of the wheelchair showing one wheel articulated rearward with its arm raised.

FIG. 2 shows a side view of the wheelchair with the pivoted arm assembly 17 rotated rearward about the pivot located at its second end. The pivot arm gear like device matingly engages the hand wheel link gear like device 9 and as said pivoted arm assembly is rotated rearward, the hand wheel link 4 and the hand wheel 3 rotate rearward stopped by the engagement of the brake pad 15 with the hand wheel. The rearward motion of the hand wheel is overcentering and, thus, the weight of the chair retains the hand wheel in the rearward position. The ratio of the gear like devices 9 and 11 shall be sufficient to allow the pivoted arm assembly to clear the back rest 86 of the chair and the pivoted arm assembly and attached hand wheel to clear the rearward portion of the seat. An appropriate ratio of gear like device 11 with respect to gear like device 9 is 2:1. It will be recognized by those skilled in the art that other ratios may be beneficial. It will also be recognized by those skilled in the art that the gear like devices could be replaced by a slotted lever and pin arrangement or other transfer mechanism suitable for achieving the desired motion. Either wheel may be positioned rearward independently to permit access from the left and right sides. It should be noted that both hand wheels can be positioned rearward at the same time if desired.

Figure 3:
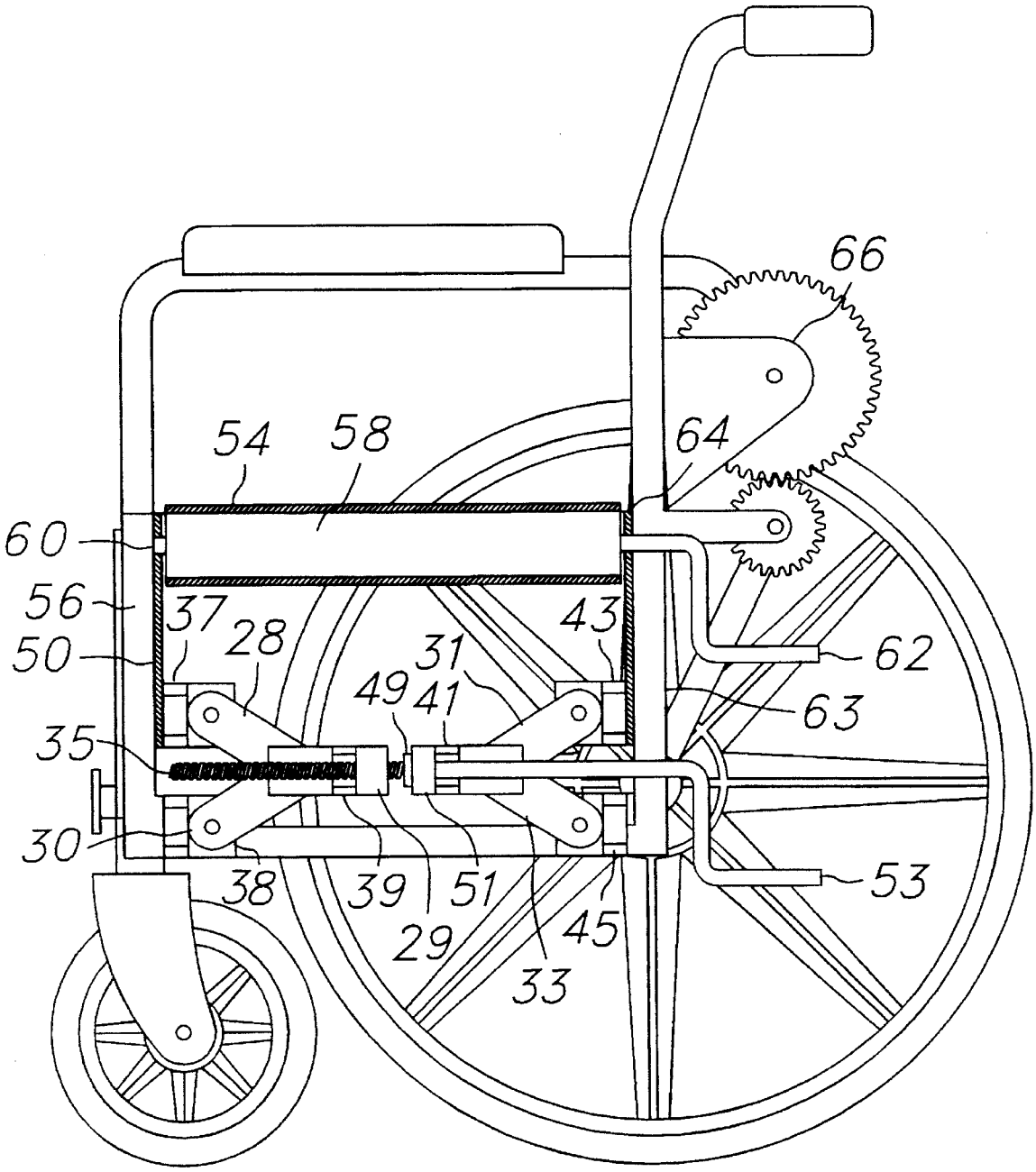
FIG. 3 is a Side Sectional View of the Wheelchair showing the lift mechanism in the lowered position, wheel rearward articulating means, and the belt transfer means.
Figure 4:
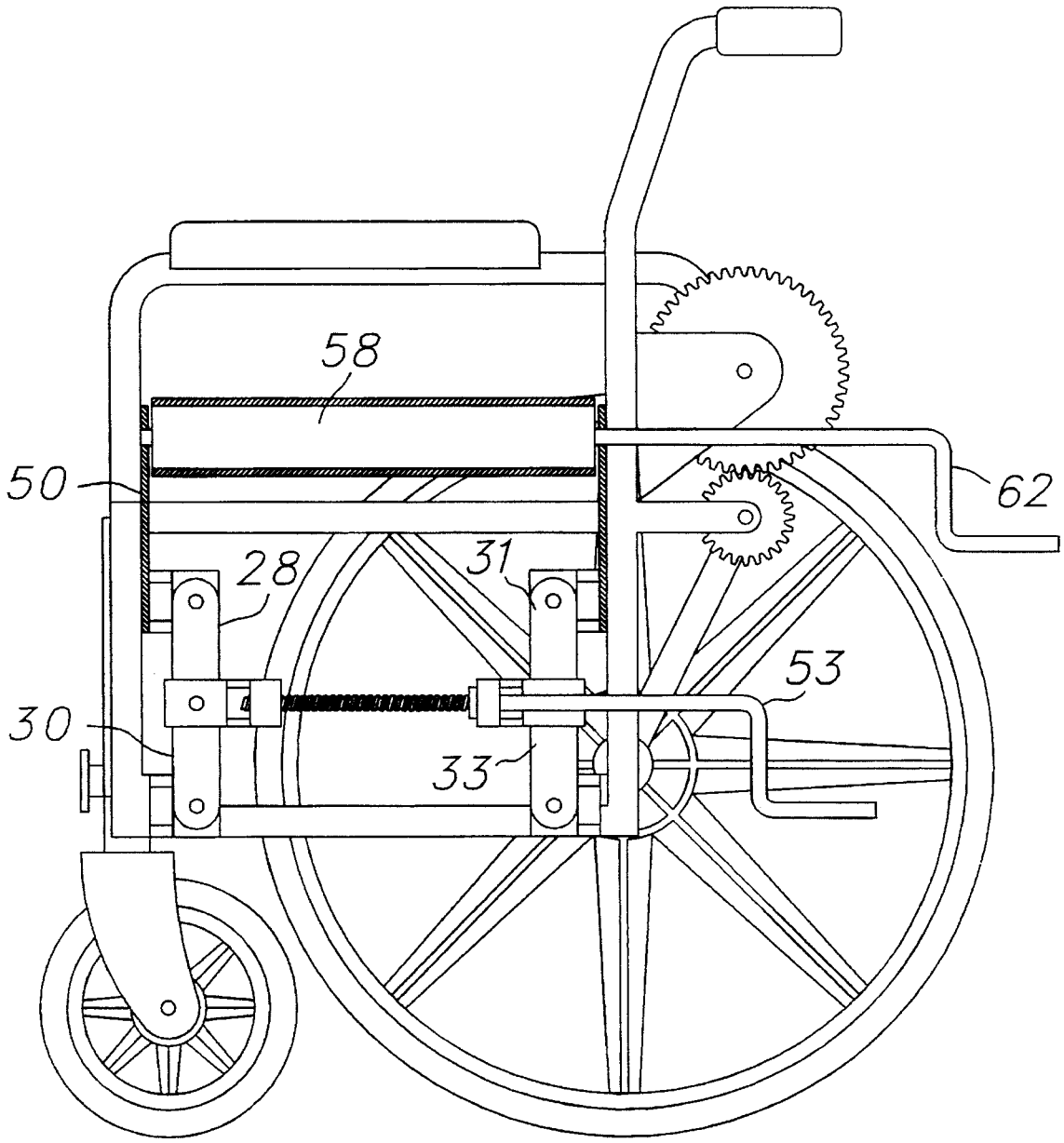
FIG. 4 is a Side Sectional View of the Wheelchair showing the lift mechanism in the raised position, wheel rearward articulating means, and the belt transfer means with the crank means extended.

FIG. 3 is a sectional view of the wheelchair showing details of the seat lift mechanism and a cross section of seat transport belt 54. The lift mechanism has four pairs of collapsible links. Two of the link pairs are shown as a first pair 28 and 30 and a second pair 31 and 33. A first end of link 30 is pivotally attached to hingeable anchor 38. Said hingeable anchor 38 has its second side rigidly affixed to the seat side frame 19. A second end of said link 30 is hingeably and pivotally attached to a leads screw interfacing nut 29. Said lead screw interfacing nut having a hinge 39. A second link 28 has a first end hingeably and pivotally attached to said lead screw interfacing nut 29 and its second end pivotally and hingeably attached to a front seat support lift bracket 50. Said front seat support lift bracket slideably retained within a slot in vertical member 56 of the seat side frame 19. A second pair of rearward links are shown as 31 and 33. A first end of link 33 is pivotally attached to hingeable anchor 45. Said hingeable anchor has its second side rigidly affixed to the seat side frame 19. A second end of said link 33 is hingeably and pivotally attached to a leads screw crank thrust guide 51. Said lead screw crank thrust guide having a hinge 41. A second link 31 has a first end hingeably and pivotally attached to said lead screw crank thrust guide 51 and its second end pivotally and hingeably attached to a rear seat support lift bracket 64. Said rear seat support lift bracket slideably retained within a slot in vertical member 63 of the seat side frame 19. Said seat lift mechanism is raised by turning crank lead screw 53. Said action causing lead screw thrust collar 49 to bear on the thrust face of the lead screw crank thrust guide 51 and the lead screw thread 35 engaged with the lead screw interfacing nut 29 to force the links apart and raise the seat lift mechanism as shown in FIG. 4.

Rotatingly attached to said front seat support lift bracket 50 and said rear seat support lift bracket 64 is a seat support roll 58 and telescopically stored transport crank 62. FIG. 4 shows said telescopically stored transport crank in the extended position to clear the wheel.

Figure 5:
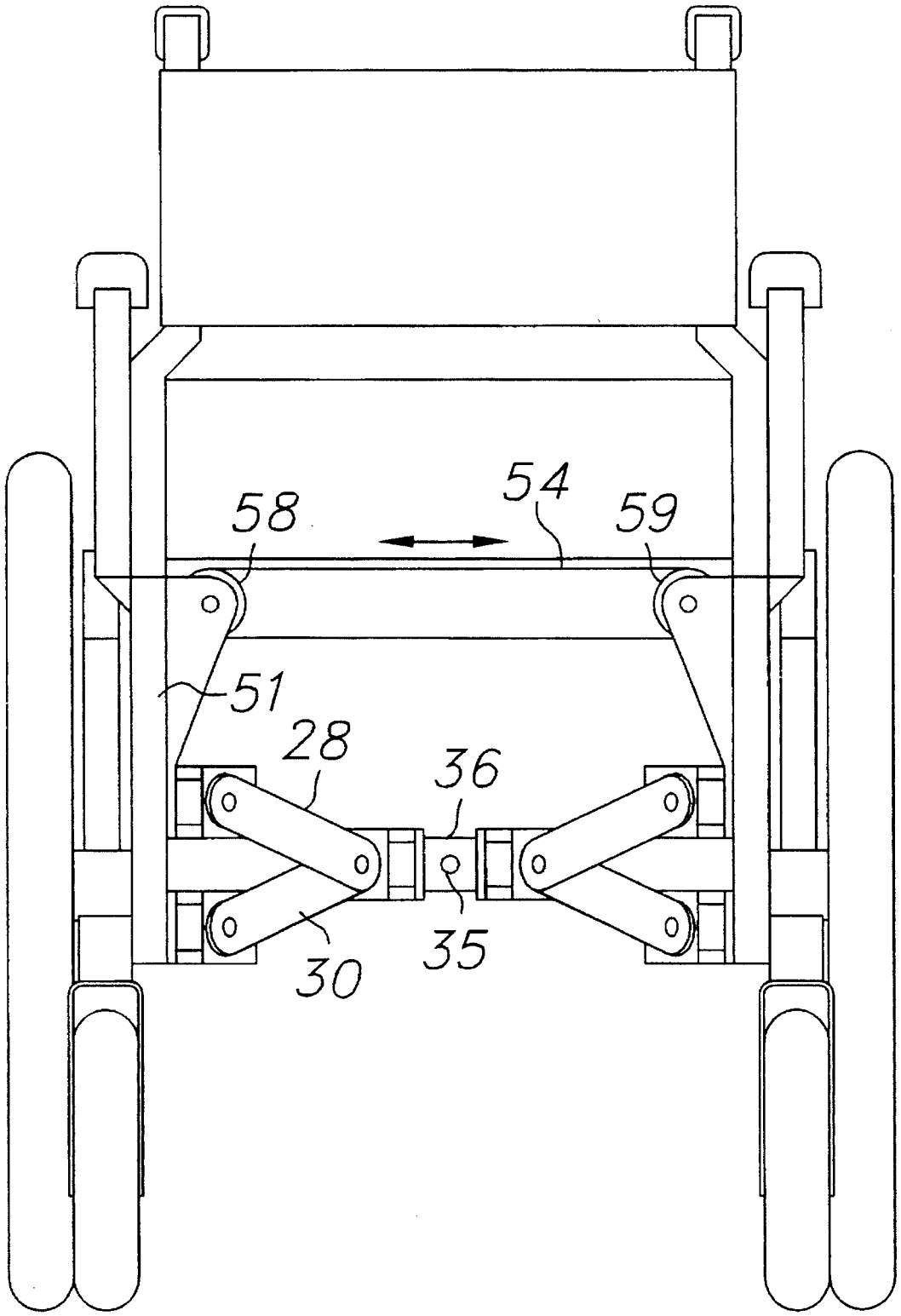
FIG. 5 is a Front View of the Wheelchair with the Chair Folding Means removed.

FIG. 5 shows a front view of the wheelchair with the folding mechanism removed to show the lift mechanism and seat belt. Said seat belt 54 is supported by seat support rolls 58 an 59. When the appropriate pivoted arm assembly 17 is raised, the path is cleared to move the patient sideways and transfer said patient to another surface such as a bed. Turning crank 62 advances the patient to the right or left.

Figure 6:
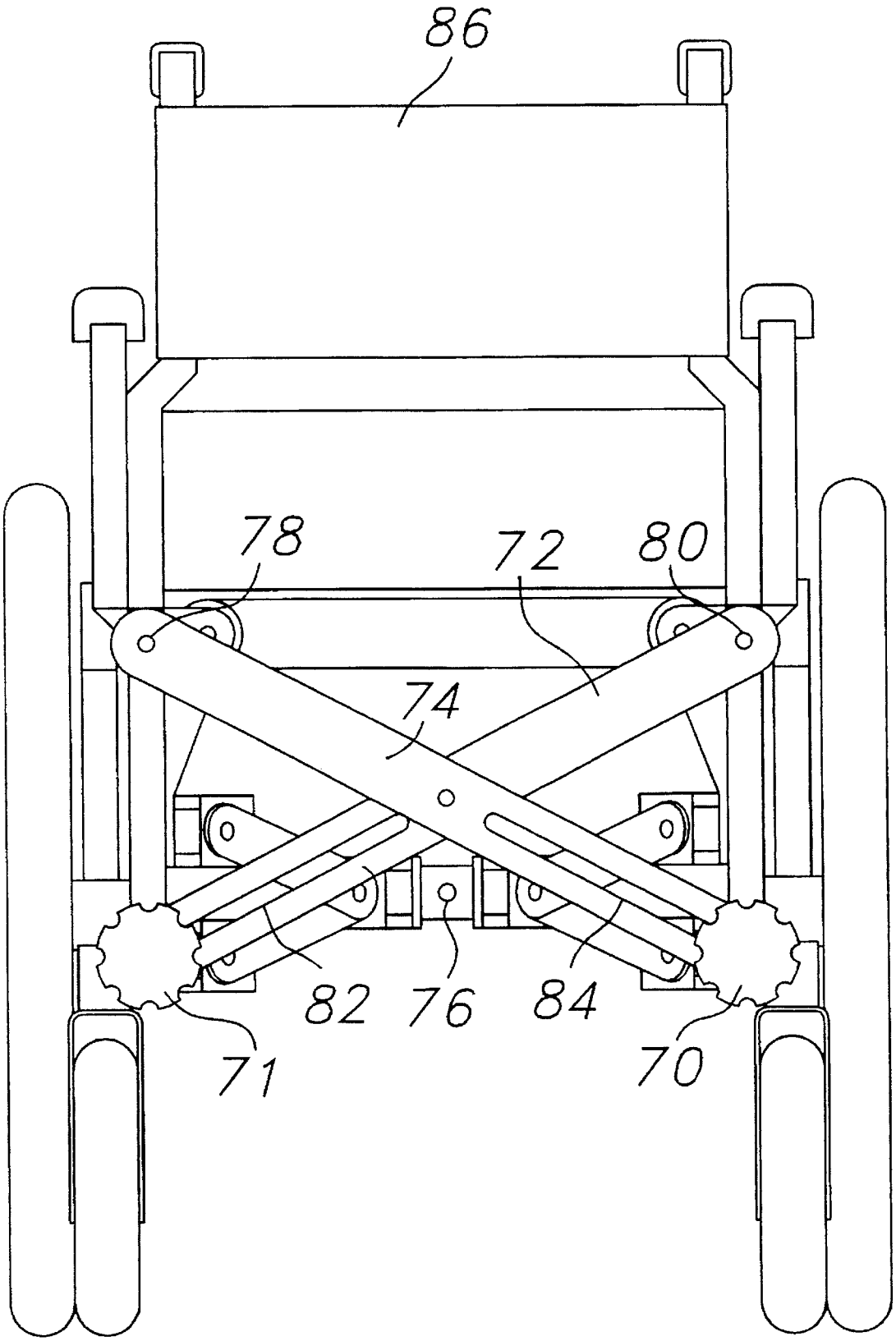
FIG. 6 is a Front View of the Wheelchair with the Chair Folding Means in place.

FIG. 6 shows a typical mechanism for lateral bracing of the chair. Said mechanism allows the chair to fold for compact transport. This mechanism is shown by way of example and is only representative of mechanisms that allow a wheelchair to fold.

In addition to the safety brake pads which engage the hand wheel when the arms are raised, the chair has a normal wheel brake. Such brakes are well known to persons familiar with the art and therefore are not herein illustrated. Additionally, foot supports and other accessories can be attached to said wheelchair without affecting the integrity of the present invention.

It will also be recognized that the leadscrew raising the seat mechanism could be connected to a reversible electric motor and appropriate switch. Also, the lead screw could be replaced by a hydraulic or pneumatic cylinder, pump, and appropriate control valving.

As will be obvious to persons skilled in the art, various modifications, adaptations, and variations of the specific disclosure can be made without departing from the teaching of the invention.

Having thus described this invention, what is claimed is:

1. A wheelchair comprising:

a main support frame;

said main support frame having a pair of forward support and seat guiding and support members and a pair of rear support and seat guiding and support members;

said main support frame having a front pair of castored wheels and a rear pair of fixed wheels;

said rear pair of fixed wheels each rotatingly affixed to an axle attached to a first end of a suspension arm:

said suspension arm having a second end firmly attached to a gear like device and pivotally affixed to a rearward portion of said main support frame;

said main support frame having an arm pivot support;

a pair of rearward pivotable arms each having a first end affixed to a gear like device and a rear pair of fixed wheels engaging brake;

said pair of rearward pivotable arms each having its first end pivotably attached at a center of said gear like device to said arm pivot support and matingly engaged with said gear like device of said suspension arm;

said pair of rearward pivotable arms each having a second end latchably attached to its forward support of the main support frame;

said second end of each of said pair of rearward pivotable arms is unlatchingly and pivotably rotatable rearward, overcenteringly pivoting its mated suspension arm rearward brakingly and stoppingly engaging said rear pair of fixed wheels engaging brake; and a seat and a back support;

a ratio of said gear like device attached to said rearward pivotable arm and said gear like device attached to said suspension arm;

said rearward pivoted arm pivotably clears said main support frame; and pivotably said suspension arm and rear pair of fixed wheels are each clearingly translatable beyond the rear portion of said seat.

2. The wheelchair of claim 1 wherein said back support has a chair pushing handle.

3. The wheelchair of claim 1 wherein said wheelchair has a wheelchair folding mechanism.

4. The wheelchair of claim 1 wherein said wheelchair has an attached foot support.

5. A wheelchair comprising:

a main support frame;

said main support frame having a pair of forward support and seat guiding and support members and a pair of rear support and seat guiding and support members;

said main support frame having a front pair of castored wheels and a rear pair of fixed wheels;

said rear pair of fixed wheels each rotatingly affixed to an axle attached to a first end of a suspension arm;

said suspension arm having a second end firmly attached to a gear like device and pivotally affixed to a rearward portion of said main support frame;

said main support frame having an arm pivot support;

a pair of rearward pivotable arms each having a first end affixed to a gear like device and a rear pair of fixed wheels engaging brake;

said pair of rearward pivotable arms each having its first end pivotably attached at a center of said gear like device to said arm pivot support and matingly engaged with said gear like device of said suspension arm;

said pair of rearward pivotable arms each having a second end latchably attached to its forward support of the main support frame;

said second end of each of said pair of rearward pivotable arms is unlatchingly and pivotably rotatable rearward, overcenteringly pivoting its mated suspension arm rearward brakingly and stoppingly engaging said rear pair of fixed wheels engaging brake;

a seat and a back support;

a ratio of said gear like device attached to said rearward pivotable arm and said gear like device attached to said suspension arm;

said rearward pivoted arm pivotably clears said main support frame;

pivotably said suspension arm and rear pair of fixed wheels are each clearingly translatable beyond the rear portion of said seat;

said seat being attached to a seat support being raisable by means of a set of four pairs of pivotable interconnecting links spreadingly separated by a spreading means;

a first end of a first of two pairs of said set of four pairs of pivotable interconnecting links hingeably and pivotally attached to said main support frame and a second end hingeably and pivotally attached to said spreading means;

a first end of a second of two pairs of said set of four pairs of pivotable interconnecting links hingeably and pivotally attached to said seat support and a second end hingeably and pivotally attached to said spreading means; and said seat support slideably engaged with said pair of forward support and seat guiding and support members and said pair of rear support and seat guiding and support members.

6. The wheelchair of claim 5 wherein said back support has a chair pushing handle.

7. The wheelchair of claim 5 wherein said wheelchair has a wheelchair folding mechanism.

8. The wheelchair of claim 5 wherein said wheelchair has an attached foot support.

9. The wheelchair of claim 5 wherein said spreading means is a hydraulic cylinder spreading means;

said hydraulic cylinder spreading means having a first end of a second of two pairs of said set of four pairs of pivotable interconnecting links hingeably and pivotally attached to said seat support and a second end hingeably and pivotally attached to said hydraulic cylinder;

a first end of a second of two pairs of said set of four pairs of pivotable interconnecting links hingeably and pivotally attached to said seat support and a second end hingeably and pivotally attached to said hydraulic cylinder; and said hydraulic cylinder spreading means filled and emptied by means of a hydraulic fluid pump, and controlled by a control valve.

10. The wheelchair of claim 5 wherein said spreading means is a leadscrew spreading means.

11. The wheelchair of claim 10 wherein said leadscrew spreading means is connected to a reversible electric motor and control switch.

12. A wheelchair comprising:

a main support frame;

said main support frame having a pair of forward support and seat guiding and support members and a pair of rear support and seat guiding and support members;

said main support frame having a front pair of castored wheels and a rear pair of fixed wheels;

said rear pair of fixed wheels each rotatingly affixed to an axle attached to a first end of a suspension arm;

said suspension arm having a second end firmly attached to a gear like device and pivotally affixed to a rearward portion of said main support frame;

said main support frame having an arm pivot support;

a pair of rearward pivotable arms each having a first end affixed to a gear like device and a rear pair of fixed wheels engaging brake;

said pair of rearward pivotable arms each having its first end pivotably attached at a center of said gear like device to said arm pivot support and matingly engaged with said gear like device of said suspension arm;

said pair of rearward pivotable arms each having a second end latchably attached to its forward support of the main support frame;

said second end of each of said pair of rearward pivotable arms is unlatchingly and pivotably rotatable rearward, overcenteringly pivoting its mated suspension arm rearward brakingly and stoppingly engaging said rear pair of fixed wheels engaging brake;

a seat and a back support;

a ratio of said gear like device attached to said rearward pivotable arm and said gear like device attached to said suspension arm;

said rearward pivoted arm pivotably clears said main support frame;

pivotably said suspension arm and rear pair of fixed wheels are each clearingly translatable beyond the rear portion of said seat;

said seat being attached to a seat support being raisable by means of a set of four pairs of pivotable interconnecting links spreadingly separated by a spreading means;

a first end of a first of two pairs of said set of four pairs of pivotable interconnecting links hingeably and pivotally attached to said main support frame and a second end hingeably and pivotally attached to said spreading means;

a first end of a second of two pairs of said set of four pairs of pivotable interconnecting links hingeably and pivotally attached to said seat support and a second end hingeably and pivotally attached to said spreading means;

said seat support slideably engaged with said pair of forward support and seat guiding and support members and said pair of rear support and seat guiding and support members;

said seat having a pair of rollers with each roller rotatingly attached to each of a forward seat support and a rear seat support;

a moveable patient transporting belt like seat encompassing said pair of rollers;

a seat engaging crank engaged with a single roller of said pair of rollers; and said moveable patient transporting belt like seat translating sideways upon turning said seat engaging crank.

13. The wheelchair of claim 12 wherein said back support has a chair pushing handle.

14. The wheelchair of claim 12 wherein said wheelchair has a wheelchair folding mechanism.

15. The wheelchair of claim 12 wherein said wheelchair has an attached foot support.

16. The wheelchair of claim 12 wherein said spreading means is a hydraulic cylinder spreading means;

said hydraulic cylinder spreading means having a first end of a second of two pairs of said set of four pairs of pivotable interconnecting links hingeably and pivotally attached to said seat support and a second end hingeably and pivotally attached to said hydraulic cylinder;

a first end of a second of two pairs of said set of four pairs of pivotable interconnecting links hingeably and pivotally attached to said support and a second end hingeably and pivotally attached to said hydraulic cylinder; and said hydraulic cylinder spreading means filled and emptied by means of a hydraulic fluid pump, and controlled by a control valve.

17. The wheelchair of claim 12 wherein said spreading means is a leadscrew spreading means.

18. The wheelchair of claim 17 wherein said leadscrew spreading means is connected to a reversible electric motor and control switch.

19. The wheelchair of claim 12 wherein said seat engaging crank is telescopically storable within said single roller of said pair of rollers.

* * * * *